US005280145A

United States Patent [19]

Mosier et al.

[11] Patent Number: 5,280,145

[45] Date of Patent: Jan. 18, 1994

[54] SWITCH ACTUATING MECHANISM

[75] Inventors: Arthur R. Mosier, Long Beach; Chris T. Burket, Huntington Beach, both of Calif.

[73] Assignee: Jay-El Products, Inc., Carson, Calif.

[21] Appl. No.: 998,841

[22] Filed: Dec. 30, 1992

[51] Int. Cl.[5] ..... H01H 9/16

[52] U.S. Cl. ..... 200/313; 200/314; 200/345; 200/DIG. 47

[58] Field of Search ..... 200/310, 311, 313, 314, 200/DIG.

[56] References Cited

U.S. PATENT DOCUMENTS

| | | | |
|---|---|---|---|
| 3,336,456 | 4/1967 | Ploetz | 200/314 |
| 4,163,883 | 8/1979 | Boulanger | 200/314 |
| 4,670,637 | 6/1987 | Kaiwa et al. | 200/313 X |
| 5,081,329 | 1/1992 | Mitwinski et al. | 200/314 |
| 5,128,842 | 7/1992 | Kenmochi | 200/DIG. 47 X |

*Primary Examiner*—Henry J. Recla
*Assistant Examiner*—Glenn T. Barrett
*Attorney, Agent, or Firm*—J. E. Brunton

[57] ABSTRACT

A unitized, switch activating mechanism for use in keyboard assemblies for activating snap dome or similar type switches. The mechanism includes a relatively hard actuating tip portion disposed intermediate an elastomeric conical skirt portion and a light guide portion. The conical skirt functions both as a light reflector and as a return spring. The light guide portion is constructed from a diffused translucent, relatively hard elastomeric material which functions as a highly efficient light guide for uniformly illuminating the key legend of the key board assembly with which the light guide interfaces.

15 Claims, 2 Drawing Sheets

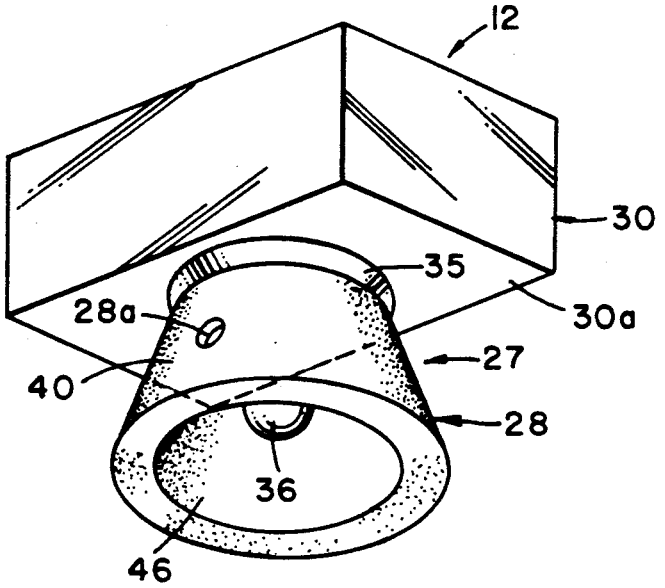
FIG. 1
FIG. 3
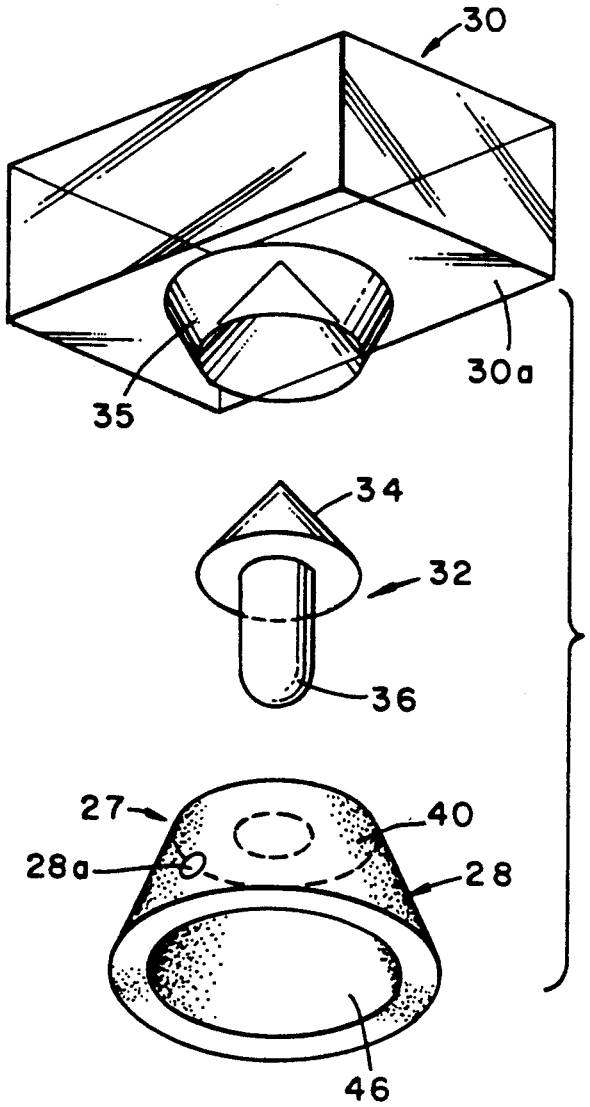
FIG. 2
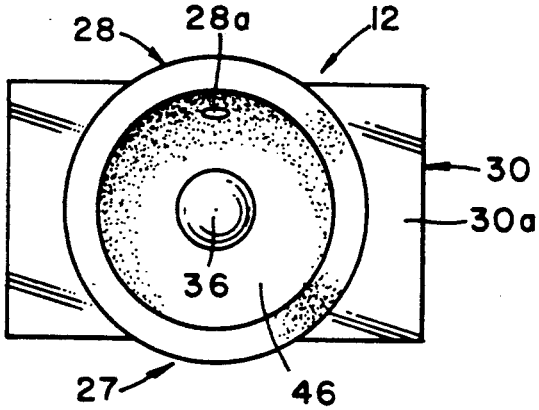
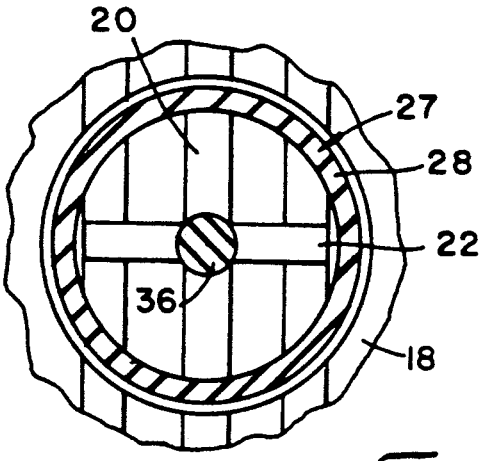
FIG. 6

SWITCH ACTUATING MECHANISM

BACKGROUND OF THE INVENTION

1. Field of the Invention

The present invention relates generally to mechanisms for activating electrical switches. More particularly, the invention concerns an improved switch actuating mechanism for use with a keyboard assembly having a light source and embodying snap dome or similar type electrical switches.

2. Discussion of the Invention

A number of different kinds of switch actuating mechanisms for use in various keyboard applications have been suggested. These include elastomeric key pad actuators in a key matrix format and multiple, single function, discrete component switch activating assemblies. These latter assemblies are relatively complex and comprise a number of separate and discrete single function components such as light guides, light plates, plungers, return springs, contact pins, and contact actuating elements.

The prior art elastomeric key pad actuators typically comprise a "waffle-like" sheet which is provided with a number of actuator key elements arrayed in rows and columns. While these types of actuators are of simple design and include a minimum number of discrete components, they typically lack the ability to pipe sufficient light from adjacent light sources to effectively illuminate the actuating keys.

Other prior art switch actuating mechanisms include capactive, touch-type activators, optical interrupted beam type actuators and piezo-electric-type activators. As a general rule, these latter types of devices have limited applicability and are appropriate for only certain specialized applications.

As will better be appreciated from the discussion which follows, the switch actuating mechanism of the present invention exhibits numerous advantages over the prior art. For example, the device of the present invention is extremely simple in design, is highly reliable, is very inexpensive to manufacture and includes highly novel integrated light management features not found in any of the prior art switch actuating devices.

SUMMARY OF THE INVENTION

The switch activating mechanism of the present invention uniquely comprises a unitized elastomeric component which includes a relatively hard actuating tip disposed intermediate an elastomeric conical skirt and a novel light guide. The conical skirt functions both as a light reflector and as a return spring. The light guide comprises a diffused translucent, relatively hard prism element which functions to interface the key face with the actuating tip and also functions as a highly efficient light guide for uniformly illuminating the key legend with which is associated.

With the aforementioned structure in mind, it is an object of the present invention to provide a simple, inexpensive and highly reliable switch actuating mechanism for actuating snap dome and similar type switches.

It is another object of the invention to provide a switch actuating mechanism of the aforementioned character which includes a skirt portion that efficiently and uniformly reflects light from adjacent light sources and effectively transmits it toward a light guide which functions to collect the light reflected by the start portion and to uniformly illuminate the key legend with which the mechanism is associated.

Another object of the invention is to provide a device of the character described in the preceding paragraphs in which the light reflecting element of the device also functions as an effective spring return.

Another important object of the invention is to provide a switch actuating mechanism of the character described in which the light guide of the device also functions to interface the device with the associated key face and additionally serves to transmit to the operator the tactile sensation of the snap dome or like switch with which the device is operably associated.

Another object of the invention is to provide a device as described in the preceding paragraph in which the light guide functions to homogenize bright and dim areas on the lighted characters of the key legend.

Still another object of the invention is to provide a switch actuating mechanism in which each of the portions thereof cooperate to effectively transmit to the operator the tactile sensation of the switch being actuated.

Yet another object of the invention is to provide a mechanism of the class described which functions to controllably resist key depression and then to automatically return the key with which the mechanism is associated to its initial at-rest position after having been depressed and then released by the operator.

These and other objects of the invention as uniquely activated by the novel switch activation mechanism illustrated in the drawings and described in the paragraphs which follow.

BRIEF DESCRIPTION OF THE DRAWINGS

FIG. 1 is a generally perspective view of one form of the switch actuating mechanism of the present invention.

FIG. 2 is a bottom view of the mechanism.

FIG. 3 is a generally perspective exploded view of the switch actuating mechanism of FIG. 1.

FIG. 6 is a cross-sectional view taken along lines 6—6 of FIG. 5.

DESCRIPTION OF THE INVENTION

Figure 4:
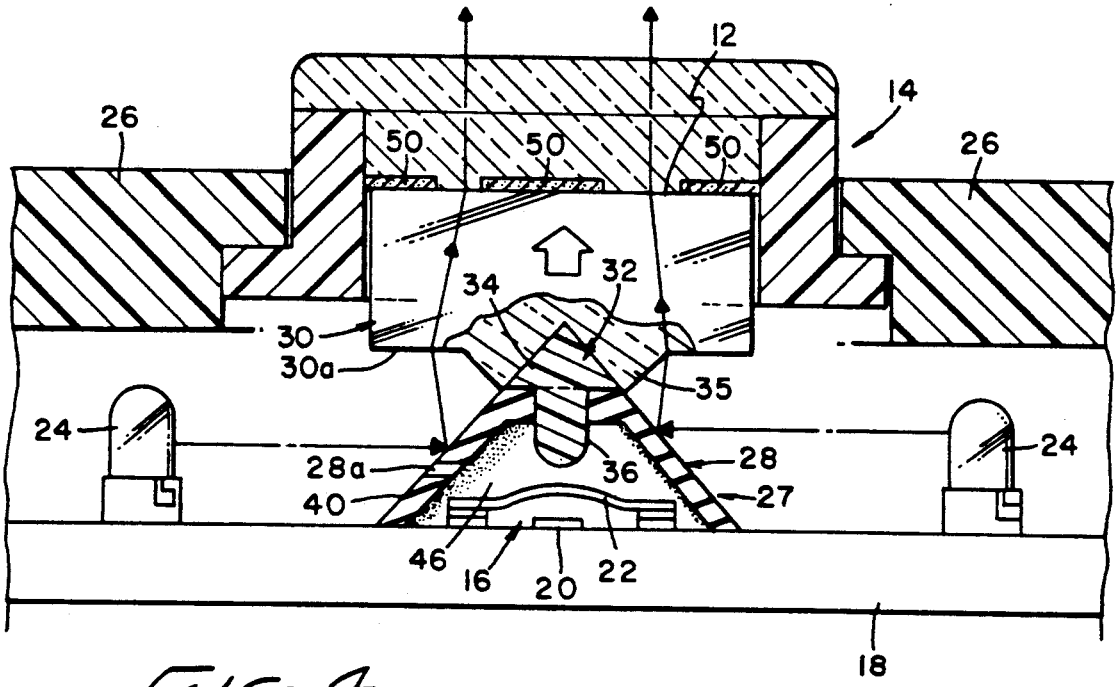
FIG. 4 is an enlarged, side-elevational view partly in cross section of the switch actuating mechanism mounted within one form of the key housing.

Referring to the drawings and particularly to FIGS. 1, 3 and 4, one form of the apparatus of the invention is there illustrated. The invention comprises a switch actuating device, generally designated by the numeral 12, adapted for use with a keyboard assembly of the character shown in FIG. 4. The keyboard assembly includes a depressible key housing 14 superimposed over a switch assembly 16 which is mounted on a base 18. Switch assembly 16 comprises a first switch contact 20 fixedly connected to base 18, and a second yieldably, deformable contact 22 superimposed over contact 20. Switch element 22 is generally domed shaped and is movable from a switch open position shown in FIG. 4 to a switch closed position shown in FIG. 5. This type of switch is generally referred to as a "snap dome" switch in that, due to the character of contact 22, after being depressed into the configuration shown in FIG. 5 it will automatically snap back to the switch open position shown in FIG. 4.

The keyboard assembly also includes a pair of light sources 24 which are mounted on base 18 adjacent switch assembly 16. The purpose of these light sources will presently be described. Superimposed over light sources 24 is a face plate assembly 26 which includes the previously-mentioned depressible key housing 14. Key housing 14 is adapted to be moved from the first at-rest position shown in FIG. 4 to the depressed position shown in FIG. 5 upon a downward pressure being exerted on the key by the operator in the manner depicted in FIG. 5.

Forming a particularly important aspect of the present invention is the switch actuating device 12. Turning particularly to FIGS. 1, 2 and 3 this unique actuating device comprises a reflector means for reflecting light from the light sources in a first direction, switch engaging means connected to the reflector means for engaging the switch and light guide means for deforming the reflector means and for guiding light toward the depressible key. In the embodiment of the invention shown in the drawings, the reflector means includes an elastomeric member 27 having reflector portion 28 and the light guide means comprises a translucent elastomeric member 30 which is partly receivable within depressible key housing 14 in the manner shown in FIG. 4.

As best seen in FIG. 3, the switch engaging means is disposed intermediate reflector member 27 and member 30 and comprises a substantially rigid member 32 having a first portion 34 which is connected to member 30 and a second downwardly protruding switch actuating portion 36. First portion 34 is generally conical in shape and is closely receivable within a cavity of corresponding shape formed within a generally dish shaped protuberance 35 provided on the lower surface 30a of member 30. Second portion 36 of the switch engaging means is closely receivable within reflector portion 28 in the manner shown in FIG. 4.

As best seen in FIG. 4, skirt or reflector portion 28 is generally conically shaped having a generally 45 degree wall 40 and includes a hollow interior 46 into which portion 36 of the switch engaging means extends.

Switch engaging member 32 is preferably made from hard silicon elastomer having a relatively high durometer reading (for example, a Shore A instrument reading of greater than 80). Reflector member 27, on the other hand, is preferably made from a softer silicone elastomer having a readily yieldably deformable skirt portion adapted to function as a return spring. The light guide 30, is also preferably made from rather hard silicone elastomer as, for example, a Shore A reading of about 80. The switch engaging means can be affixed to member 30 and portion member 28 by any suitable means such as bonding with an appropriate adhesive to create a unitized structure. It is also to be understood that the reflector portion, the switch engaging means, and the translucent member can also be constructed in a single piece of silicone elastomer or like material to which an appropriate reflective coating has been added to the outer surface of the reflector portion.

A number of different kinds of materials other than silicone elastomer can be used in the construction of the switch actuating device of the present invention. The general material requirements are that the material be resilient, have a durometer range from soft to hard, be clear to slightly translucent and be capable of pigmentation so as to be highly reflective to visible light. Further, the material must have the ability to transmit to the operator's fingers shock waves resulting from actuation of the switch and, in certain instances, must also meet various end use environmental requirements. The material may be moldable thermo-plastic or may be moldable or castable thermo set material.

Materials found suitable for the construction of the switch actuating device include a silicone elastomer material sold under the name and style "SILASTIC" which is available from Dow Corning Company, a fluorosilicone material also available from Dow Corning Company, various fluorocarbon materials available from 3M, duPont, and M. W. Kellogg, and certain chloroprene polymers available from duPont. Other suitable materials include ethylene vinyl acetate; olifinic polymers, available from Monsanto; polyurethane; polyester; and acrylic polymers, all available from a number of well-known manufacturers. Suitable materials also include isobutylene-lsoprene co-polymers, (butyl rubber) and styrene butadiene co-polymers available from Shell Oil Company.

Figure 5:
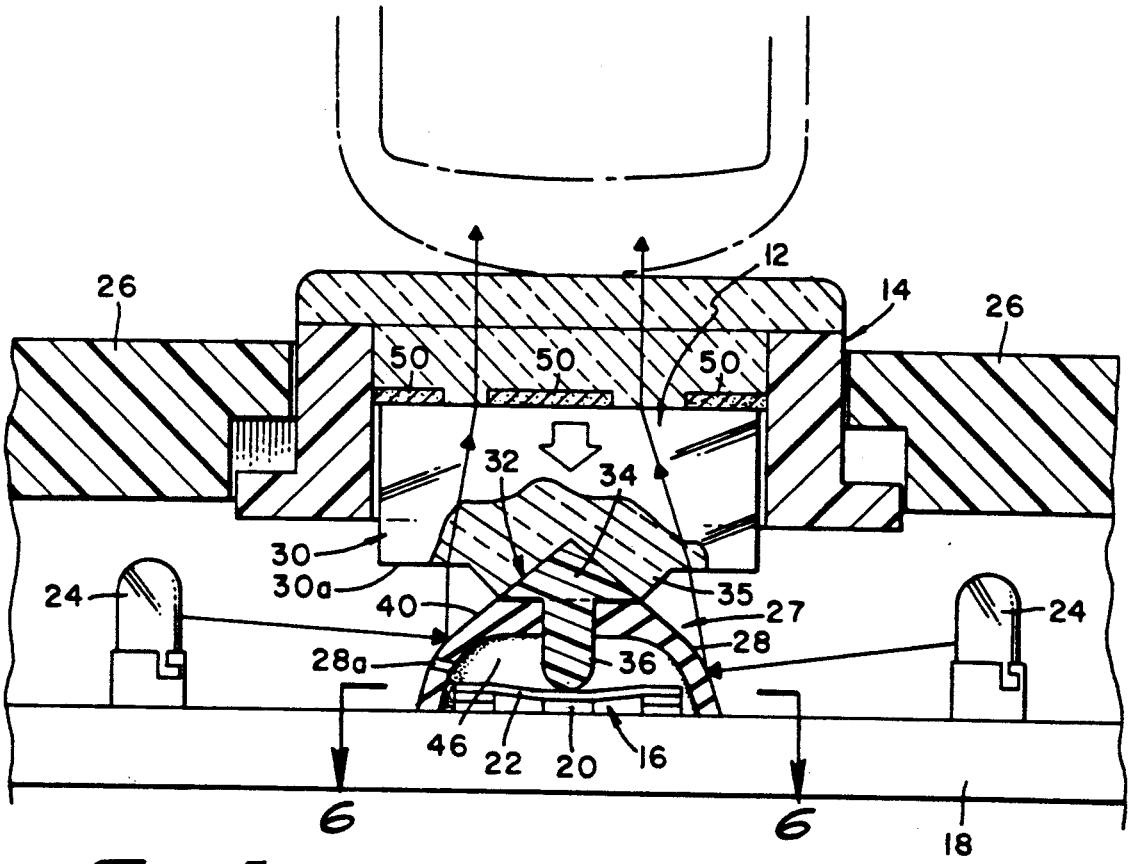
FIG. 5 is a side-elevational view similar to FIG. 4 but showing the switch actuating mechanism in a depressed actuating position.

In operating the apparatus of the invention, when the depressible key is depressed from the at-rest position shown in FIG. 4 to the switch actuating position shown in FIG. 5, portion 36 of the switch engaging means is brought into contact with dome-shaped contact 22 causing contact 22 to snap into the switch closed position shown in FIG. 5. Because of the carefully selected hardness of the material used to make the light guide and switch actuating portions, the tactile sensation of the switch contact 22 snapping into the closed position will be transmitted through the switch actuating device to the finger of the user thereby positively signaling the closing of the switch.

As the key is depressed by the operator into the position shown in FIG. 5, the resiliently deformable skirt portion 28 of the reflector means, or reflector member 27, will be yieldably deformed in the manner shown in FIG. 5. Upon release of the downward pressure on the key, the material characteristics of the skirt portion will cause the member to act as a return spring and to automatically return the device to the position shown in FIG. 4 thereby returning the key to its normal at-rest position. Skirt portion 28 is provided with a small vent hole 28*a* to permit air to escape from the interior of the skirt.

When the key is in its at-rest position, light from light source 24 will be efficiently and uniformly reflected from the outer reflecting surfaces of skirt portion 28 in the manner shown by the arrows in FIGS. 4 and 5. The skirt portion is preferably constructed of a resiliently deformable material which is pigmented so as to exhibit a very white light reflecting surface so that a substantial portion of the light received from the light sources will be reflected toward the light guide. The light reflected from the skirt portion of the reflector will enter the translucent light guide member 30 in the manner indicated by the arrows and, due to the unique reflective characteristics of the light guide member, will uniformly and effectively illuminate the key legends provided on the depressible key. Further, due to the unique light guiding characteristics of the light guide element, the light being reflected from the reflector element will be collected and homogenized so as to uniformly and effectively light the characters 50 of the key legend. It is to be noted that the light guide means, or member 30, serves three important purposes, namely to act as an interface with the key housing of the keyboard assembly; to transmit the tactile sensation of the switch closing to the operator and to uniformly illuminate the key legends using the light reflected from the reflector means.

The reflector means, or member 27 also provides three important functions. Firstly, the elastomeric skirt portion 28 provides a predetermined, optimum resistance to depression of the key with which it is associated. Secondly, after being depressed, the skirt portion functions as a return spring to automatically return the key to its initial position. Finally, and of significant importance, the unique configuration and highly reflective surface of the skirt portion being a 45 degree conic section insures that a substantial amount of the light received from the light sources 24 is reflected toward the light guide member 30. It is to be understood that the skirt portion could be formed at angles other than 45 degrees to obtain other angles of reflectance.

The actuator tip, or switch engaging means, uniquely serves three purposes, namely to transmit operator actuating forces to the switch; to transmit to the operator the tactile sensation of the switch closing; and efficiently reflect the light from the light sources to the light guide member.

Being of a unitized, highly simple and straight forward design, the switch actuating mechanism of the invention is highly reliable and its "discrete key" design permits substantial application flexibility.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A switch actuating device for use with an assembly having a light source, a switch and a depressible element, said device comprising:

(a) reflector means for reflecting light from the light source in a first direction, said reflector means being yieldably deformable from a first upstanding position to a second depressed position;

(b) switch engaging means connected to said reflector means for engaging the switch when said reflector means is in said second depressed position; and (c) light guide means connected to said switch engaging means for deforming said reflector means in response to depression of the depressible element and for receiving reflected light from said reflector means and guiding said reflected light toward the depressible element.

2. A device as defined in claim 1 in which said reflector means comprises an elastomeric member having a yieldably deformable, skirt portion superimposed over the switch, said skirt portion including a reflective surface for reflecting light from said light source in said first direction.

3. A device as defined in claim 2 in which said switch engaging means comprises a member having a first portion in engagement with said light guide means and a second portion extending internally of said skirt portion of said reflector means adapted for engaging the switch when said reflector means is in said second depressed position.

4. A device as defined in claim 3 in which said first portion of said switch engaging means is generally conical in shape and in which said block includes a cavity configured to closely receive said first portion of said switch engaging means.

5. A device as defined in claim 2 in which said light guide means comprises a translucent block adapted to be connected to the depressible element.

6. A device as defined in claim 5 in which said block comprises silicone elastomer rubber.

7. A switch actuating device for use with a keyboard switch assembly and a depressible key housing superimposed over the switch, said device comprising:

(a) a reflector having a frustoconically shaped skirt portion adapted to be superimposed over the switch, said skirt portion being yieldable deformable from a first, upstanding portion to a second, deformed position, and including a reflecting surface adapted for reflecting light received from a light source in a first direction;

(b) switch engaging means carried by said reflector for engaging the switch when said reflector is in said second deformed position; and (c) a translucent member adapted to be partially receivable within the depressible key housing and connected to said switch engaging means for deforming said skirt portion of said reflector upon depression of the key housing, said translucent member being disposed in a path of light being reflected from said reflecting surface in said first direction.

8. A device as defined in claim 7 in which said switch engaging means comprises a member having a first portion connected to said translucent member and a second portion extending interiorly of said skirt portion of said reflector adapted for engaging the switch when said skirt portion is in said second, deformed position.

9. A device as defined in claim 7 in which said translucent member comprises a silicone elastomer block having a 60 to 100 share durometer.

10. A device as defined in claim 9 in which said switch engaging means comprises a rigid silicone member.

11. A device as defined in claim 10 in which said reflector is constructed from a yieldably deformable white silicone elastomer material.

12. A keyboard assembly, comprising:

(a) a base;

(b) a switch mounted on said base, said switch having a first and second contact, said first contact being yieldable deformable between a first switch open position to a second switch closed position;

(c) a light source mounted on said base proximate said switch;

(d) a face plate assembly supported by and spaced apart from said base, said keyboard assembly including a depressible key housing;

(e) a switch actuating mechanism connected to said depressible key housing, said switch actuating mechanism comprising:

(i) reflector means for reflecting light from the light source in a first direction, said reflector means being yieldably deformable from a first upstanding position to a second depressed position;

(ii) switch engaging means connected to said reflector means for engaging the switch when said reflector means is in said second depressed position; and (iii) light guide means connected to said switch engaging means for deforming said reflector means in response to depression of the key housing and for receiving reflected light from said reflector means and guiding said reflected light toward the key housing.

13. A device as defined in claim 12 in which said reflector means comprises an elastomeric member having a yieldably deformable, skirt portion superimposed over the switch, said skirt portion including a reflective surface for reflecting light from said light source in said first direction.

14. A device as defined in claim 13 in which said switch engaging means comprises a member having a first portion in engagement with said light guide means and a second portion extending internally of said skirt portion of said reflector means for engaging the switch when said reflector means is in said second depressed position.

15. A device as defined in claim 13 in which said light guide means comprises, a translucent elastomeric block connected to the depressible key housing.

* * * * *